US008262199B2

(12) United States Patent
Takahashi

(10) Patent No.: US 8,262,199 B2
(45) Date of Patent: Sep. 11, 2012

(54) DROPLET JETTING HEAD, METHOD OF MANUFACTURING DROPLET JETTING HEAD, AND DROPLET JETTING APPARATUS EQUIPPED WITH DROPLET JETTING HEAD

(75) Inventor: Shuji Takahashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 324 days.

(21) Appl. No.: 12/562,865

(22) Filed: Sep. 18, 2009

(65) Prior Publication Data

US 2010/0079546 A1 Apr. 1, 2010

(30) Foreign Application Priority Data

Sep. 30, 2008 (JP) ..... 2008-254182

(51) Int. Cl.
*B41J 2/135* (2006.01)

(52) U.S. Cl. ..... 347/45

(58) Field of Classification Search ..... 347/44, 347/45, 47, 54, 56, 63, 64, 65, 68–72
See application file for complete search history.

(56) References Cited

FOREIGN PATENT DOCUMENTS

| | | | |
|---|---|---|---|
| JP | 7-195693 | A | 8/1995 |
| JP | 2007-245589 | A | 9/2007 |

*Primary Examiner* — Kristal Feggins
(74) *Attorney, Agent, or Firm* — Sughrue Mion, PLLC

(57) ABSTRACT

A droplet jetting head that is obtained by bonding a first substrate 22 in which a through hole 20 is formed, and a second substrate 18*r* having a pressure chamber 12 together with an adhesive 24 is provided wherein an end of a surface of the through hole 20 in the first substrate 22 that contacts the adhesive 24 has a round shape having a curvature radius of from 1 to 100 μm.

13 Claims, 8 Drawing Sheets

DROPLET JETTING HEAD, METHOD OF MANUFACTURING DROPLET JETTING HEAD, AND DROPLET JETTING APPARATUS EQUIPPED WITH DROPLET JETTING HEAD

CROSS-REFERENCE TO RELATED APPLICATION

This application is based on and claims priority under 35 USC 119 from Japanese Patent Application No. 2008-254182 filed on Sep. 30, 2008, the disclosure of which is incorporated herein by reference in its entirety.

BACKGROUND OF THE INVENTION

1. Field of the Invention

The present invention relates to a method of manufacturing a droplet jetting head, a droplet jetting head obtained by the method, and a droplet jetting apparatus equipped with the droplet jetting head, and specifically, to a method of manufacturing a droplet jetting head that jets droplets in order to form an image and is suitable for ink jet recording, a droplet jetting head obtained by the method, and a droplet jetting apparatus equipped with the droplet jetting head.

2. Description of the Related Art

A droplet jetting apparatus that jets droplets by an ink jet printing method or the like to form an image on a recording medium by aggregation of dots formed by the droplets is known.

The performance of this kind of droplet jetting apparatus greatly depends on the performance of the droplet jetting head provided in this apparatus. Such a droplet jetting head imparts electrical or thermal energy to a droplet, thereby jetting the droplet from an opening for jetting, the droplet being stored until the droplet is jetted.

A configuration of a general droplet jetting head is shown in FIG. 1. Here, the droplet jetting head 10 is configured such that a substrate 18 that forms a pressure chamber, provided with a pressure chamber 12 holding a liquid and imparting pressure, an opening 14 for jetting a droplet, and an opening 16 for liquid supply that supplies the liquid to the pressure chamber 12, is bonded together with an adhesive 24 to a substrate 22 that forms a flow passage, provided with a liquid passage 20 that supplies the liquid for jetting from a tank (not shown) or the like filled with droplets. The substrate 22 that forms a flow passage includes a relief portion 28 for a pressure supply unit 26 that imparts pressure to the liquid held by the pressure chamber 12, and the pressure supply unit 26 is disposed in this space. Further, a wiring 27 for driving the pressure supply unit 26 is provided.

The substrate 22 that forms a flow passage and the substrate 18 that forms a pressure chamber are firmly bonded together by an adhesive. As the bonding method, an adhesive is applied to the surface of the substrate 18 to form an adhesive layer 24, the substrate 22 is superposed and compressed on the surface of the substrate 18 such that the opening 16 for liquid supply and a through hole (liquid passage) 20 formed in the substrate 22 are substantially aligned with each other, and both substrates are bonded together by curing the adhesive layer 24.

Here, when both of the substrates are pressed and bonded together, a situation may occur in which a part of the adhesive that has not been cured extrudes and protrudes into the through hole and is cured. When a portion of the adhesive protrudes in this way, it affects the flow passage of the liquid. When the liquid includes a solvent or an oil component, such as ink, a part of the resulting cured adhesive may melt and become mixed into the liquid, or a part of the adhesive may be peeled off and become mixed into the liquid due to surface strength degradation thereof, thereby affecting the composition of droplets. Other adverse effects, such as the clogging of a nozzle caused by the peeled-off adhesive, are also a concern.

When the amount of the adhesive is decreased in order to prevent the above adverse effects and the like, the adhesion between the substrates becomes weaker, and the durability of the jetting head deteriorates.

As a technique that can be applied in order to address this issue, a technique whereby a metal or a metal oxide as a bonding layer is provided at least at the joining areas of the substrates to be joined together has been suggested, in order to prevent the peeling off of an adhesive and improve reliability (for example, refer to JP-A No. 2007-245589). However, formation of the bonding layer with a metal or the like causes a problem in that an increase in process steps, such as a film forming step and a patterning step, complicate the process, and furthermore the problem of adhesive protrusion is not completely solved. A further technique, whereby a groove that receives adhesive is formed in a substrate that forms a flow passage, is known as a method of preventing protrusion of adhesive (for example, refer to JP-A No. 7-195693). However, this technique forms a recess, as seen in a joining cross-section, in order to receive excessive adhesive therein, and the step of forming the recess is complicated and therefore problematic.

SUMMARY OF THE INVENTION

As a result of intensive study, the present inventors have found that the protrusion of adhesive can be suppressed by providing a round shape (rounding) to the end of a through hole of a substrate that forms a flow passage, have devised a simple method that provides such a round shape, and have thereby completed the present invention.

The present invention has been made in view of the above circumstances and provides a droplet jetting head, a method of manufacturing the droplet jetting head, and a droplet jetting apparatus equipped with the droplet jetting head.

According a first aspect of the present invention, there is provided the following droplet jetting head.

<1> a droplet jetting head that jets droplets to a recording medium on the basis of image information, thereby forming dots on the recording medium to form an image indicated by the image information on the recording medium, and that is obtained by bonding together with an adhesive a first substrate that forms a flow passage, in which at least a through hole is formed, and a second substrate that forms a pressure chamber, having a pressure chamber, an opening 16 for liquid supply that supplies a liquid to the pressure chamber, and an opening 14 for liquid jetting, wherein an end of a surface of the through hole in the first substrate that contacts the adhesive has a round shape having a curvature radius of from 1 to 100 μm.

BRIEF DESCRIPTION OF THE DRAWINGS

Exemplary embodiments of the present invention will be described in detail based on the following figures, wherein.

DETAILED DESCRIPTION OF THE INVENTION

Figure 1:
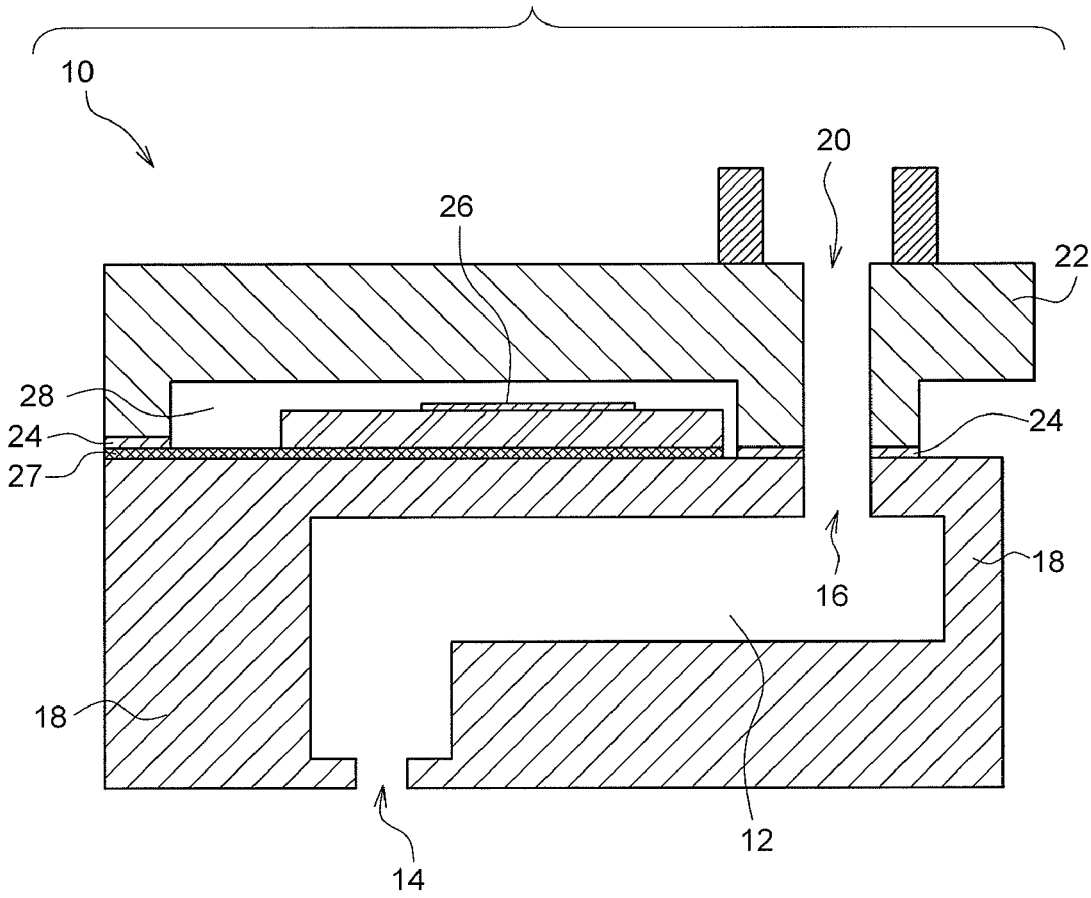
FIG. 1 is a schematic sectional view showing one aspect of the configuration of a droplet jetting head obtained by bonding a first substrate that forms a flow passage and a second substrate that forms a pressure chamber together.

According to a second aspect to a ninth aspect of the present invention, there are provided the following droplet jetting heads, methods of manufacturing the droplet jetting head, and droplet jetting apparatus equipped with the droplet jetting head.

<2> The droplet jetting head described in <1>, wherein the adhesive extends along the inside of the through hole of the first substrate (the adhesive is provided in the state of extending along the round shape).

By providing the end of the through hole with the above round shape, the ability of the adhesive to stretch is improved, and higher strength bonding is realized without adhesive protrusion into the flow passage.

<3> The droplet jetting head described in <1> or <2>, wherein the first substrate and the second substrate are each a silicon substrate.

<4> The droplet jetting head described in any one of <1> to <3>, wherein the through hole inner surface of the second substrate is formed with a silicon oxide film, or is subjected to water-repellent treatment.

<5> The droplet jetting head described in <3>, wherein the silicon substrate of the second substrate has a fluorine-based polymer as a protective film.

<6> The droplet jetting head described in any one of <1> to <5>, wherein the adhesive viscosity is an epoxy-based adhesive having about 100 to 100000 cP.

<7> A method of manufacturing a droplet jetting head described in any one of <1> to <6>, the method including:

forming a patterned mask to create a flow passage in a silicon substrate used in the fabrication of a first substrate that forms a flow passage;

curing the patterned mask, in which the patterned mask is heated to form a round shape at the end of the patterned mask;

forming a through hole by dry etching, and then providing a round shape to an end of the through hole by dry etching, thereby providing the first substrate with a through hole having a round shape formed at an end thereof; and bonding the first substrates with a second substrate having a pressure chamber with an adhesive, so that the through hole of the obtained first substrate, and an opening 16 that supplies liquid to the pressure chamber in the second substrate substantially align with each other.

By this simple method, the droplet jetting head of the above configuration can be manufactured.

<8> The method of manufacturing a droplet jetting head described in <7>, wherein the heating temperature in heating of the mask is within a range of from T° C. to T+100° C., where the melting point of a material that forms a mask is T° C.

A mask pattern that becomes a resist can be changed from a rectangular shape to a suitable round shape by selecting the temperature condition in curing, and an excellent round shape can be easily provided to the end of the through hole by dry-etching the formed resist.

<9> The method of manufacturing a droplet jetting head described in <7> or <8>, wherein the thickness of the mask is from 3 to 15 μm.

A round shape is easily given to the end of the through hole of the substrate by adjusting the thickness to the above range.

<10> The method of manufacturing a droplet jetting head described in any one of <7> to <9>, wherein dry etching is performed under the condition that the dry etching selection ratio between a material that forms a mask and a first substrate material is 1 or less after the forming of the through hole.

By making the dry etching selection ratio low, an excellent round shape at the end of the through hole can be easily formed after the formation of the through hole.

<11> The method of manufacturing a droplet jetting head described in any one of <7> to <10>, further including performing a surface treatment, which improves the wetting property of the adhesive, on the surface of the first substrate having the through hole having a round shape at the end thereof, prior to the bonding, but after the forming of through hole.

By performing a treatment, such as oxygen plasma treatment, which improves wetting property with respect to an adhesive, on the first substrate and the inside of the through hole, extension of the adhesive into the through hole can be performed well, adhesive protrusion can be effectively suppressed, and bonding strength can also be improved.

<12> The method of manufacturing a droplet jetting head described in any one of <7> to <11>, wherein the bonding includes forming an adhesive layer on the surface of the first substrate, bringing the second substrate into pressure contact with the surface of the adhesive layer, and curing the adhesive.

Since the adhesive in bonding extends along the inner wall of the through hole with a round shape by pressure-contacting the first substrate in which the round shape has been formed, adhesive protrusion can be suppressed, and sufficient bonding area can be secured.

<13> The method of manufacturing a droplet jetting head described in any one of <7> to <12>, wherein the adhesive extends along the inside of the through hole of the first substrate after the bringing the second substrate into pressure contact with the surface of the adhesive layer.

<14> A droplet jetting apparatus equipped with the droplet jetting head obtained by the method of manufacturing a droplet jetting head described in any one of <7> to <13>.

As described above, according to the manufacturing method of the invention, a round shape is given to an end of a portion of the through hole in the first substrate that contacts with the second substrate, whereby the adhesive extruded by pressure when the second substrate is brought into pressure contact with the adhesive layer provided on the surface of the first substrate extends along the inner wall of the through hole so as to run along the round shape of the through hole, and is cured as it is. For this reason, since sufficient bonding area by the adhesive can be secured while almost not affecting the shape of the through hole that becomes a flow passage, the bonding strength of both the substrates is also sufficiently maintained.

Additionally, according to the manufacturing method of the invention, the round shape of the end of the through hole can be easily formed by curing the mask used for forming the through hole. Therefore, the problem of bonding between the substrates can be addressed without undergoing complicated steps.

According to exemplary embodiments of the invention, it is possible to provide a method of manufacturing a droplet jetting head, obtained by bonding a first substrate that forms a flow passage and a second substrate that forms a pressure chamber together, which can simply manufacture a droplet jetting head that suppresses the alteration of a liquid caused by adhesive extrusion, deterioration of jetting performance, and the like while maintaining sufficient bonding strength between both substrates, a droplet jetting head having excellent droplet jetting stability obtained by the method, and a droplet jetting apparatus equipped with the droplet jetting head.

Hereinafter, a manufacturing method of the invention will be described in detail in the order of steps with reference to the drawings.

Figure 2A:
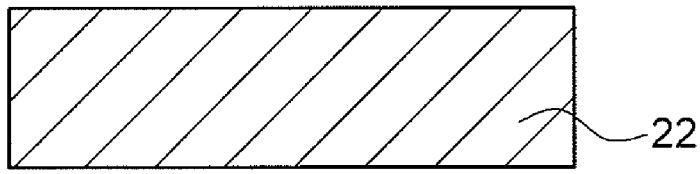
FIGS. 2A to 2I are schematic sectional views sequentially showing the steps from the preparation of a silicon substrate to through hole formation in the manufacturing method of the invention.

Mask Pattern Forming Step in which a Patterned Mask is Formed to Create a Flow Passage in a Silicon Substrate Used in the Fabrication of a Substrate that Forms a Flow Passage Here, the preparation of a substrate which is used in the fabrication of a substrate that forms a flow passage will be explained. FIG. 2A is a schematic sectional view of a silicon substrate that becomes the base of the substrate 22 that forms a flow passage.

The silicon substrate is first provided with a recess that becomes a relief portion 28 for a pressure supply unit 26. Specifically, a mask 30 for formation of the recess is first patterned on the silicon substrate (refer to FIG. 2B).

The patterned mask 30 can be applied by suitably selecting a resist material to which general-purpose photolithography can be applied. Although the thickness of the substrate may be suitably selected according to any purpose, it is generally about 200 to 700 μm.

As a material used for the formation of a mask pattern 30, photosensitive resins, such as photoresist, may be used. As the photoresist, a commercially available photoresist can be suitably used. The OFPR series and TSMR series of Tokyo Ohka Kogyo, or the 1500 series and 6000 series of AZ Company, and the like, are examples thereof.

As a method of forming a mask pattern on the silicon substrate, a resist material is applied on the silicon substrate by a spin coat method, a spray coat method, and the like to form a resist film. The thickness of the resist film may be determined in consideration of a selection ratio at the time of dry etching. Next, prebake of the resist film is performed. The prebake may be performed at the optimal temperature of the resist materials by a hot plate, an oven, or the like, and it is generally preferable that the temperature of the prebake be 90 to 120° C.

Thereafter, the pattern of the photo mask is transferred to the resist by exposure. As an exposure apparatus, a general-purpose aligner or stepper can be used, and exposure may be performed with the amount of exposure that is optimal for a resist material to be used. For example, when OFPR-800 (made by Tokyo Ohka Kogyo Co., Ltd.) is used as the resist material to form a resist film with a thickness of 1 μm, about 120 mJ/cm$^2$ is a suitable amount of exposure by the aligner.

Depending on the resist material to be used, PEB may be performed after exposure. Development is performed in order to dissolve a portion exposed after exposure or a portion that has not been exposed after exposure with a developer after exposure to form a pattern. As the developer, one that is suitable for a resist material is selected. As the development, well-known methods, such as a dipping method or a shower method, can be applied.

For example, a method of rinsing a substrate with pure water and drying the substrate after the substrate is dipped in a developer is exemplified. More specifically, for example, when the OFPR-800 (made by Tokyo Ohka Kogyo Co., Ltd.) is used as a resist material, a method of dipping a substrate for about 60 seconds in a developer tank filled with NMD-3 (made by Tokyo Ohka Kogyo Co., Ltd.) as a developer, then performing rinsing with pure water twice for 60 seconds, then performing cleaning with running water for 300 seconds, and then removing moisture on the substrate by a spin dryer, and the like is an example thereof.

After the development, post bake can also be performed as desired to promote the ability of a resist to harden. The post bake is performed by heating the substrate using a hot plate or oven, and may be performed for 1 to 60 minutes at a heating temperature of about 100 to 200° C. When the OFPR-800 is used as the resist material, it is suitable to heat the substrate for 1.5 minutes at a temperature of 110° C. by a hot plate.

Figure 2B:
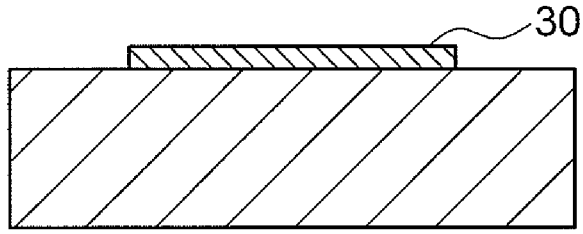
Figure 2C:
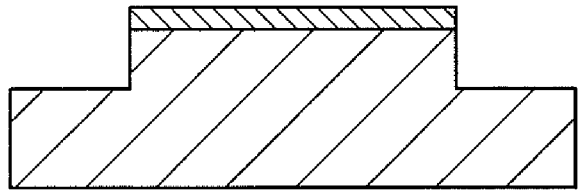

Thereafter, a recess is formed by dry etching (refer to FIG. 2C).

The silicon substrate is trench-etched by a dry etching method.

As the dry etching method, a Bosch process that repeatedly performs etching and protective film forming or a dry etching method that adds oxygen to a fluorine-based gas can be applied. By etching the silicon substrate to a predetermined depth by these methods, a recess that is the relief portion 28 for forming the pressure supply unit 26 is formed.

Among these, the Bosch process that can use a resist mask is preferable.

The Bosch process is a method of repeatedly performing etching and protective film forming by using $SF_6$ or a mixed gas of $SF_6$ and $O_2$ at the time of etching and using $C_4F_8$ at the time of protective film forming. In the example of the Bosch process, an etching process is performed for 15 seconds in a state where the flow rate of $SF_6$ is 200 sccm, the degree of vacuum is 3 Pa, the RF output for plasma production is 2000 W, and bias output is 15 W, and subsequently, a protective film forming process is performed for 10 seconds in a state where the flow rate of $C_4F_8$ is 100 sccm, the degree of vacuum is 1 Pa, the RF output for plasma production is 1500 W, and bias output is 0 W. The etching process and the protective film forming process are repeatedly performed.

When the Bosch process is applied, PEGASUS, HRM/HRMX, and SR/SRE made by Sumitomo Precision Products Co., Ltd, and MS3200/MS4200, MS200 I-Productivity, and the like made by Alcatel, which are commercially available devices, can be used.

Although the depth of the recess can be arbitrarily determined depending on the etching time, the recess is formed with a depth of about 100 μm in the case of the formation of the pressure supply unit 26.

Figure 2D:
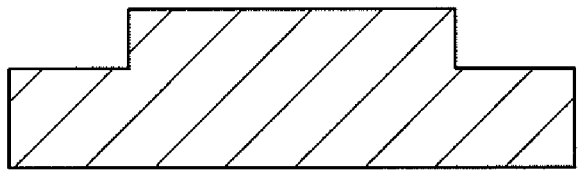

Thereafter, the mask 30 is removed (FIG. 2D).

An exclusive peeling liquid or ashing treatment may be performed in order to remove the mask. As the resist peeling liquid, for example, STRIPPER-502A by Tokyo Ohka Kogyo Co., Ltd., an AZ remover 100 made by AZ Company, and the like may be used. As the ashing treatment, ashing treatment using oxygen plasma may be performed. ICP, a microwave asher, and a barrel-type asher may be used. For example, the ashing treatment may be performed under ashing treatment conditions of oxygen gas of 200 sccm, 30 Pa, and a microwave output of 1 kW by SWP or the like using microwaves.

Figure 2E:
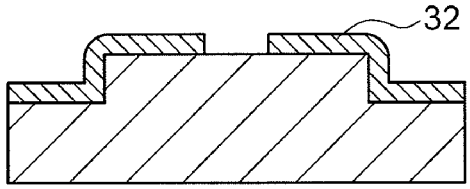

Thereafter, a mask pattern for forming a through hole that is an important requirement of the invention is formed (FIG. 2E).

A mask 32 for forming a through hole is formed on the substrate in which the recess has been made. The same resist material as the above-described materials may be used for the formation of a patterned mask. For example, the OFPR series and TSMR series of Tokyo Ohka Kogyo, and the AZ1500 series, AZ6000 series, and 10XT, of AZ Company, or the like can be used.

The thickness of the resist used for the mask may be set to an arbitrary thickness from a selection ratio at the time of dry etching. A hard mask, other than the resist, such as a silicon oxide film, a silicon nitride film, aluminum, titanium, or chromium, may be used for the mask. When the hard mask is used, the selection ratio at the time of dry etching is high, but the number of steps increases.

As a method of forming the mask pattern 32 on the silicon substrate, a resist material is applied to the silicon substrate by a spin coat method, a spray coat method, or the like. to form a resist film.

Next, prebake of the resist film is performed. The prebake may be performed at the optimal temperature with respect to various resist materials by a hot plate, an oven, or the like, and it is generally preferable that the temperature of the prebake be 90 to 120° C.

Thereafter, the pattern of the photo mask is transferred to the resist by exposure. As an exposure apparatus, a general-purpose aligner or stepper can be used, and exposure may be performed with the amount of exposure that is optimal for the resist material to be used. Depending on the resist to be used, PEB may be performed after exposure.

In addition, it is preferable that the thickness of the mask be 3 to 15 μm from the viewpoint that a round shape is easily given to the end of the through hole of the substrate by curing the patterned mask.

Subsequently, development is performed in order to dissolve an exposed portion or an unexposed portion with a developer thereby forming a pattern. Development is performed by rinsing the substrate with pure water after the substrate is dipped in a developer, and drying the substrate.

As the developer, commercially available developers may be used. For example, NMD-3 of Tokyo Ohka Kogyo, AZ300MIF developer and AZ400K developer of AZ Company, and the like are examples of the developer.

Thereafter, post bake is performed. The substrate is heated using a hot plate or oven. The heating may be performed for 1 to 60 minutes at a heating temperature of about 100 to 200° C.

In this embodiment, AZ10XT (220 cP) made by AZ Company is used as the resist material. A resist film with a film thickness of about 10 μm is formed by spinning the substrate for 60 seconds at 1000 rpm by the spin coat method, and subsequently, post bake is performed. As for the post bake, the substrate is heated for 180 seconds at 110° C. by a hot plate.

Pattern exposure is performed on the formed patterned mask (resist film) 32 by using a contact aligner. When the resist thickness is 10 μm, the pattern exposure may be performed with an exposure amount of 825 mJ/cm$^2$.

As for the development, the substrate is dipped in the AZ300MIF developer as the developer for 600 seconds, is then rinsed with pure water twice for 60 seconds, is dipped in running water for 180 seconds, and is spin-dried or nitrogen-blown to remove moisture.

In this way, the patterned mask 32 for formation of a through hole is formed.

Figure 2F:
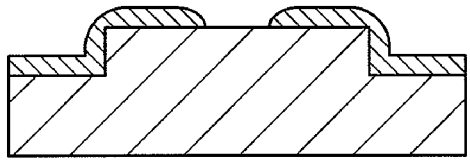

Curing Step of Heating Patterned Mask to Form Round Shape at End of Patterned Mask The formed patterned mask is heated, and the mask 32 is deformed (FIG. 2F).

Figure 3A:
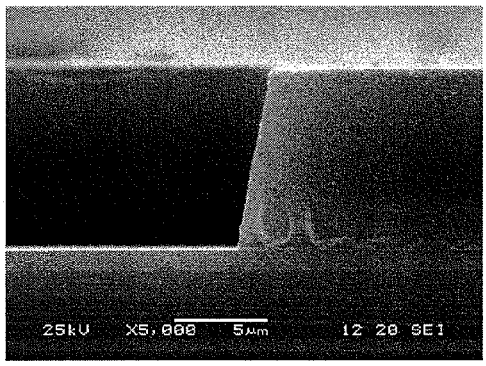
FIG. 3A is a cross-section of a mask pattern up to a curing step.
Figure 3B:
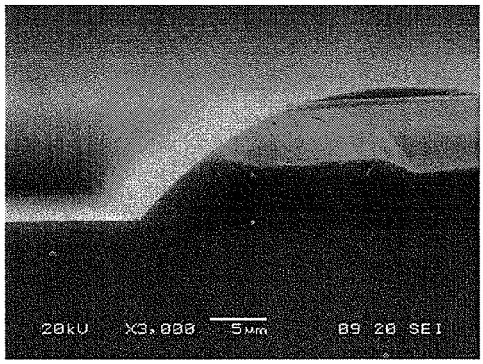
FIG. 3B is a sectional view of the mask pattern after the curing step.

By performing the "curing step" of heating the mask 32 formed of a resist material at a high temperature, the resist is subjected to reflow, and corners of the rectangular mask are rounded off. FIG. 3A is a sectional view of the formed mask pattern, FIG. 3B is a sectional view of the mask pattern after a heating step is performed, and it can be seen from the comparison between them that the mask pattern of FIG. 3A has been deformed into a gentle shape as shown in FIG. 3B by heating.

The heating may be performed by a hot plate or oven, and where the melting point of the resist material (cured material) that constitutes a mask is T° C., the heating may be performed such that the curing temperature becomes a temperature of T° C. or higher. It is noted that, since the mask cannot maintain its shape if temperature is too high, it is preferable that the upper limit of the heating temperature be set to about (T+100)° C.

Specifically, when the 10XT of AZ Company is used for a resist, patterning is performed by exposure and development to form a mask, and then the mask is heated for 120 seconds at 130° C. by a hot plate. A resist pattern can be made into a round shape from a rectangular shape by this heating. Thus-formed patterns are shown in FIGS. 3A and 3B.

Figure 2G:
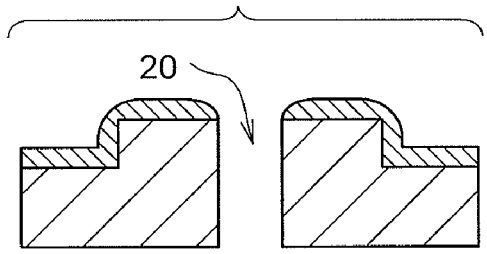

Through Hole Forming Step of Forming Through Hole by Dry Etching to Form Substrate that Forms a Flow Passage having Through Hole having Round Shape at its End Next, a through hole 20 is formed by dry etching (FIG. 2G).

The through hole becomes a liquid flow passage. The dry etching method in this case can be performed under the same conditions as those when the recess is formed in the silicon substrate.

In this step, in order to form a through hole, dry etching may be performed after the silicon substrate is bonded to a dummy substrate or the like in advance.

Although the size and shape of the through hole are suitably selected depending on the purpose to which a droplet jetting head is to be applied, the shape is generally selected from a circular shape, a square shape, a rectangular shape, or the like as the shape of an opening of the through hole. Typically, if the shape is circular, the diameter (ϕ) of the opening is about 100 to 800 μm, and the size of the opening can be selected to such a degree that the same cross-sectional area as the above circle is obtained even if the shape of the opening is rectangular.

Figure 2H:
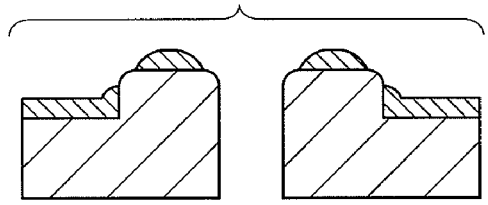

The dry etching is further performed by the same apparatus after the formation of the through hole 20 in the silicon substrate, so that a round shape can be formed at the end (corner) of the substrate that constitutes the through hole 20 (FIG. 2H).

At this time, the dry etching may be performed on the condition that the selection ratio of the etching rate of the resist mask and the silicon substrate become 1 or less.

For example, a mixed gas of a fluorine-based gas and oxygen gas, and a mixed gas of a fluorine-based gas, oxygen gas, and inert gas may be used. Sulfur hexafluoride: $SF_6$, carbon tetrafluoride: $CF_4$, nitrogen trifluoride: $NF_3$, trifluoromethane: $CHF_3$, hexafluoroethane (Fron-116): $C_2F_6$, octafluorocyclobutane: $C_4F_8$, or the like may be used as the fluorine-based gas, and argon: Ar, helium: He, nitrogen: $N_2$, xenon: Xe, or the like may be used as the inert gas. Dry etching is performed with a degree of vacuum of 1 Pa or less using these mixed gases.

For example, the selection ratio with a resist can be set to 1 or less by performing dry etching in a state where the flow rate of $SF_6$ is 75 sccm, the flow rate of $O_2$ is 25 sccm, the degree of vacuum is 1 Pa, the RF output for plasma production is 1000 W, and the bias output is 100 W. Thus, the round shape of the mask shape can be transferred to the silicon substrate by etching the silicon in a state where the selection ratio with the resist is 1 or less. Generally, the size (curvature radius) of the round shape is preferably within a range of 1 to 100 μm, and more preferably within a range of 5 to 50 μm. Additionally, it is suitable that the thickness of a surrounding wall surface that forms a flow passage be about 100 to 300 μm.

Figure 2I:
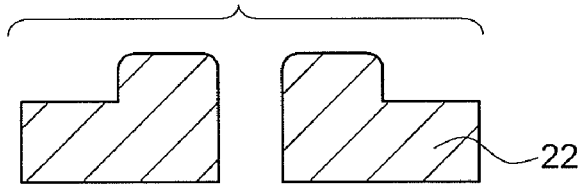

Thereafter, the mask 32 is removed (FIG. 2I).

An exclusive peeling liquid or ashing treatment may be performed in order to remove the mask 32. As the resist peeling liquid, for example, STRIPPER-502A made by Tokyo Ohka Kogyo Co., Ltd., an AZ remover 100 made by AZ Company, etc. may be used. As the ashing treatment, ashing treatment using oxygen plasma may be used. ICP, a microwave asher, or a barrel-type asher may be used. For example, the ashing treatment may be performed under the ashing treatment condition of oxygen gas of 200 sccm, 30 Pa, and a microwave output of 1 kW by SWP or the like using microwaves.

Finally, fluorine-based polymers formed at the time of silicon dry etching may be removed, for example, the Novec series by Sumitomo 3M Company or the Zeorora series by Nippon Zeon Co., Ltd. may be used.

Subsequently, it is preferable to perform hydrophilization treatment of the silicon substrate, i.e., treatment that improves wetting property with an adhesive. For example, it is preferable from the viewpoint of effectiveness to perform hydrophilization treatment of the silicon substrate by plasma treatment using oxygen plasma, a method of radiating ultraviolet rays or vacuum ultraviolet rays, etc. By this treatment, affinity with an adhesive can be improved, and adhesive protrusion to a flow passage in the bonding step can be effectively suppressed.

Figure 4J:
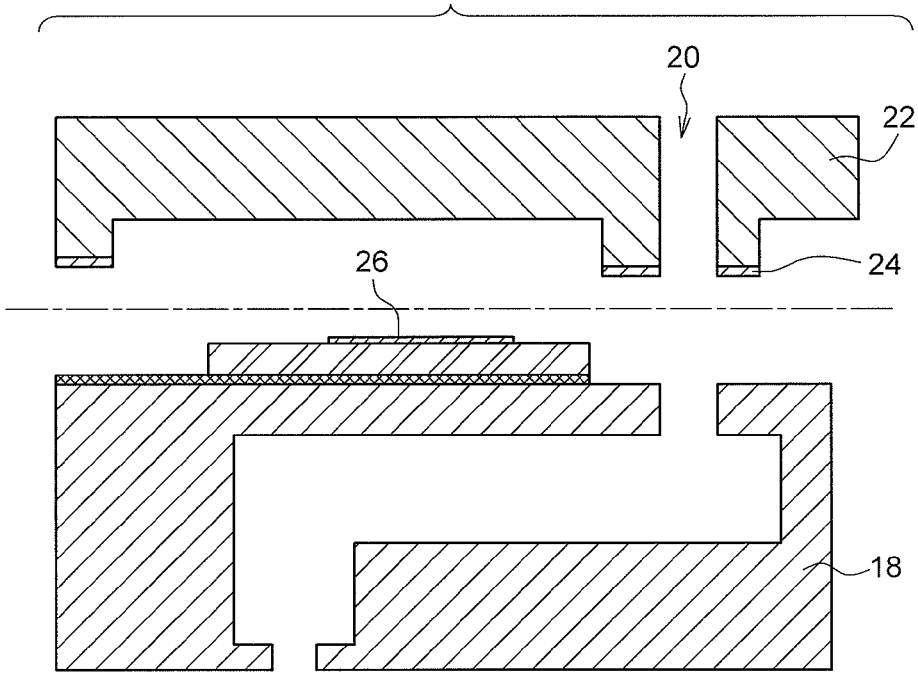
FIGS. 4J to 4K are schematic sectional views sequentially showing a step of bonding the first substrate that forms a flow passage and the second substrate that forms a pressure chamber in the manufacturing method of the invention.

Bonding Step of Bonding Through Hole of Obtained Substrate that Forms Flow Passage and Opening that Supplies Liquid from Pressure Chamber in Substrate that Forms Pressure Chamber to the Through Hole Together with Adhesive so that Both Substantially Align with Each Other In this step, first, an adhesive is applied to the surface of at least one substrate to form an adhesive layer (FIG. 4J).

An adhesive 24 is applied to the bonding surface of at least one of the substrate 22 forms a flow passage or the substrate 18 that forms a pressure chamber. It is preferable from the viewpoint of the ability of an adhesive to stretch that the adhesive be applied to the substrate 22 that forms a flow passage and that the substrate 18 that forms a pressure chamber be brought into pressure contact with the substrate that forms a flow passage.

It is preferable that a material whose viscosity is about 100 to 100000 cP be selected as the adhesive, from the viewpoint that the adhesive is stretched along the inside of the through hole of the substrate that forms a flow passage. Additionally, it is preferable to use an epoxy-based adhesive from the viewpoint of adhesion and durability. Here, the viscosity of an adhesive can be measured by suitably selecting and using a general-purpose viscometer.

Additionally, as the adhesive, commercially available adhesives can be suitably used, for example, the EW series and SW series made by Sumitomo 3M, the 2000 series made by Three Bond Co., Ltd., the EP series made by Cemedine Co., Ltd., and the like are examples thereof The adhesive may be applied only to a predetermined portion by a dispenser or the like. It is preferable that the film thickness of an adhesive layer be about 5 to 100 μm.

In addition, a silane coupling agent may be applied to the bonding surface of each substrate before the adhesive is applied. Adhesion with the adhesive is improved by using the silane coupling agent.

Figure 4K:
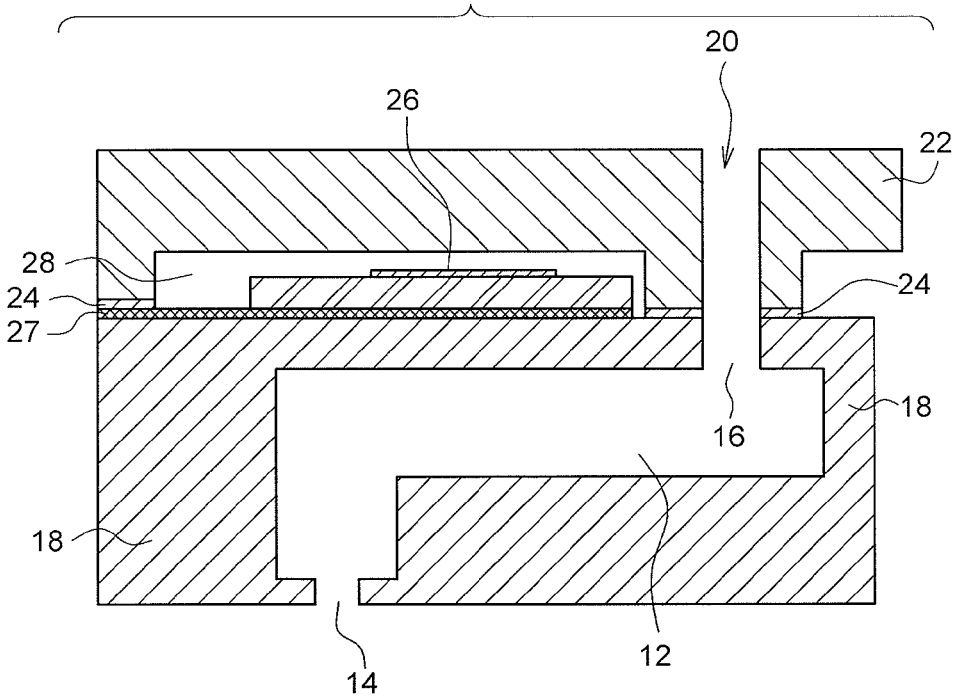

Thereafter, both substrates are stuck together (FIG. 4K).

If necessary, the adhesive is heated or pressed to cure. For example, the adhesive may be heated to about 200° C. from room temperature.

By bringing both substrates into pressure contact with each other, the adhesive is stretched along the round shape of the through hole of the substrate that forms a flow passage, is cured in a state where the adhesive layer has extended to the inner wall of the through hole, and the area of contact between the adhesive layer and the substrate that forms a flow passage increases, whereby bonding strength is improved.

In this way, the substrate forms a pressure chamber and the substrate that forms a flow passage are firmly bonded together, and a pressure applying means is provided in the aforementioned relief portion, whereby the droplet jetting head of the invention is formed.

The obtained droplet jetting head may be suitably used for various kinds of droplet jetting apparatuses that jets droplets by pressurizing the droplets electrically or physically.

Hereinafter, an operating mechanism whereby the adhesive layer is extended to the inside of the through hole of the substrate that forms a flow passage when both substrates are bonded together will be described.

In the configuration of the invention, the relationship between the surface energy of each part that constitutes the droplet jetting head is adjusted as expressed in the following formula.

Surface energy of flow passage side surface of substrate that forms a pressure chamber<Surface energy of surface of substrate that forms a pressure chamber≦Surface energy of surface and through hole inside of substrate that forms a flow passage (Formula)

Specifically, the flow passage side, i.e., the through hole inner surface of the substrate 18 that forms a pressure chamber is formed with a silicon oxide film, or is subjected to water-repellent treatment.

The substrate 18 that forms a pressure chamber is a silicon substrate, and is in a state where a fluorine-based polymer that is a protective film is formed when silicon is processed by dry etching. In the invention, it is preferable not to remove this fluorine-based polymer but to maintain this polymer adhesion condition up to the bonding step. In addition, the fluorine-based polymer may be removed after the bonding step.

In the substrate 18 that forms a pressure chamber, the surface energy when a silicon oxide film is formed on the flow passage side, i.e., on the inside of the opening for liquid supply is 200 to 400 (mN/m), and the angle of contact to the water is about 30 to 50 degrees. Additionally, the surface energy in a case when the above-mentioned fluorine-based polymer adheres to the surface is 18 to 40 (mN/m), the angle of contact to the water is 90 degrees or more, and the substrate is in a liquid-repellent state.

Additionally, when the substrate 18 that forms a pressure chamber is formed of the silicon substrate, the surface energy is 930 (mN/m) and the angle of contact to the water is about 20 degrees. Moreover, the substrate 22 that forms a flow passage is formed of the silicon substrate as above. However, when the substrate is subjected to hydrophilization treatment, the surface energy becomes 1000 (mN/m) or more, the angle of contact to the water also becomes 5 degrees or less, and the substrate becomes super-hydrophilic.

Since the surface energy of the adhesive 24 to be used for the bonding of both substrates is generally 74 (mN/m) or less, which is the surface energy of water, and the adhesive has a higher wetting property with respect to the substrates than the water, the relationship of the surface energy of each member satisfies the above formula. As a result, when the adhesive is applied to form an adhesive layer and the substrate 18 that forms a pressure chamber and the substrate 22 that forms a flow passage are brought into pressure contact with each other, the adhesive 24 that has been extruded by pressure from gaps is stretched along the round shape inside the through hole 20 of the substrate 22 that forms a flow passage that becomes wet more easily. Therefore, the adhesive is prohibited from protruding toward an ink flow passage to form a convex portion, and the adhesive is prohibited from extending to the opening side (direction) of the substrate that forms a pressure chamber.

From the viewpoint of improving such effects, it is preferable that the above processing that improves the wetting property with respect to the adhesive is performed on the surface of the substrate 22 that forms a flow passage including the through hole inside. Additionally, in the substrate 18 that forms a pressure chamber, the processing that improves the wetting property to the adhesive may be performed on the upper surface that is the contact surface with the adhesive layer. However, it is preferable that the inside of the opening 16 for liquid supply maintains water repellence (low surface energy state) until after completion of the bonding step.

Droplet Jetting Apparatus

The droplet jetting head of the invention is obtained as described above. This droplet jetting head may be suitably used for various kinds of droplet jetting apparatuses. Although a droplet jetting apparatus that can use the droplet jetting head of the invention will be described below taking one aspect of an image recording apparatus as an example, the apparatus that can apply the droplet jetting head of the invention is not limited to this.

Figure 5:
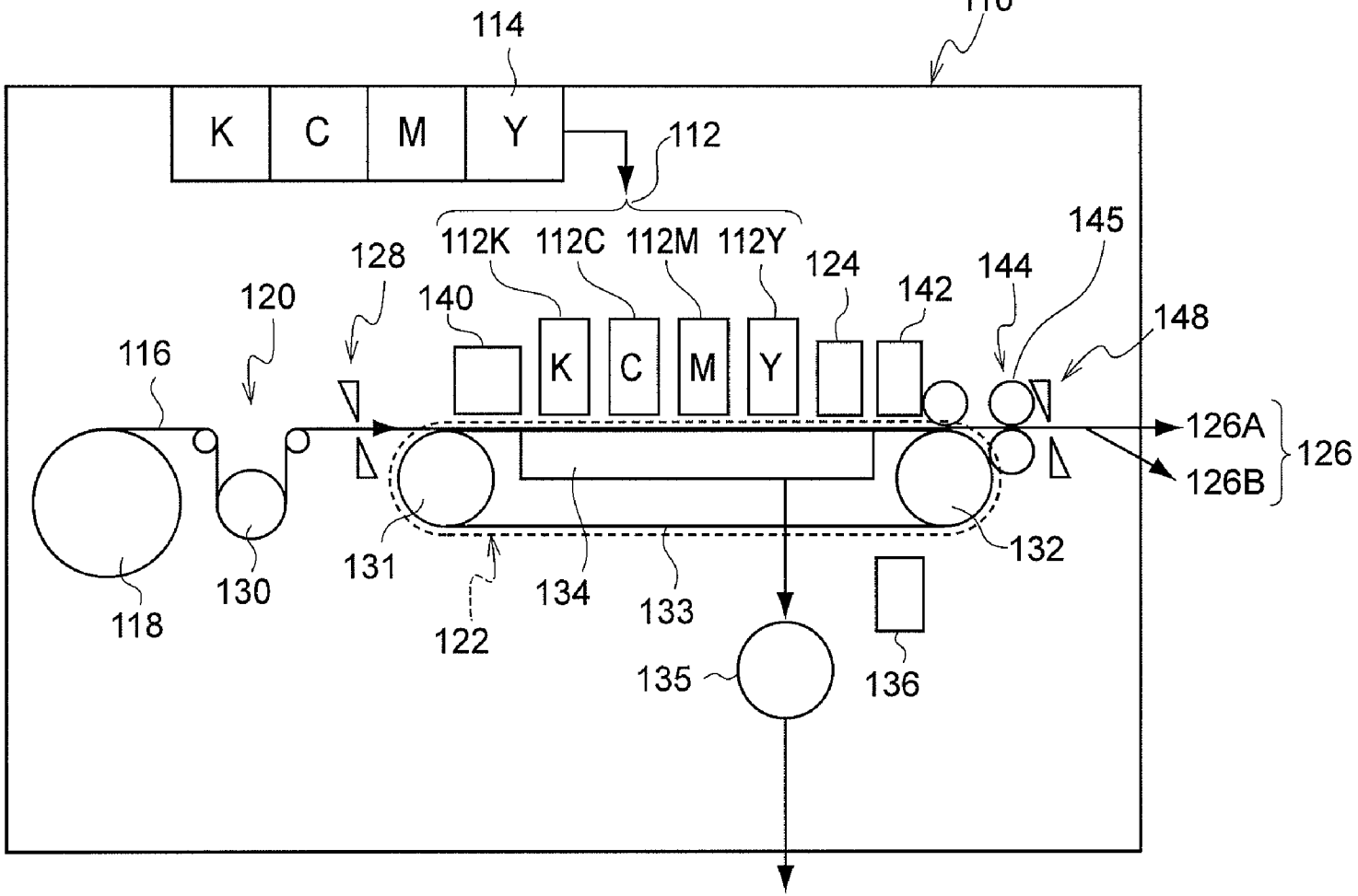
FIG. 5 is an entire configuration view showing one embodiment of an image forming apparatus to which a droplet jetting head of the invention can be applied.

FIG. 5 is an entire configuration view of an ink-jet recording apparatus showing one exemplary embodiment of an image forming apparatus equipped with the droplet jetting head of the invention. As shown in this drawing, the ink-jet recording apparatus 110 is provided with a printing unit 112 that has plural ink-jet recording heads (hereinafter referred to as heads) 112K, 112C, 112M, and 112Y provided so as to correspond to black (K), cyan (C), magenta (M), and yellow (Y) inks, respectively, an ink storage/loading unit 114 that stores the ink supplied to each of the heads 112K, 112C, 112M, and 112Y, a sheet feed unit 118 that feeds a recording sheet 116 that is a recording medium, a decurling unit 120 that removes curling of the recording sheet 116, a belt conveying unit 122 that is disposed to face a nozzle surface (ink jetting surface) of the printing unit 112, and conveys the recording sheet 116 while maintaining the planarity of the recording sheet 116, a printing detection unit 124 that reads printed results by the printing unit 112, and a sheet ejection unit 126 that ejects a recorded recording sheet (printed article) to the outside. In addition, the term "printing" used in this specification also includes the printing of images in addition to the printing of characters.

In the invention, the ink-jet recording head obtained by the manufacturing method of the invention is applied to at least one of the plural ink-jet recording heads 112K, 112C, 112M, or 112Y.

The ink storage/loading unit 114 has ink tanks that store color inks corresponding to the heads 112K, 112C, 112M, and 112Y, respectively, and the tanks are communicated with the heads 112K, 112C, 112M, and 112Y, respectively, via required conduit lines. Additionally, the ink storage/loading unit 114 has a notifying unit that notifies a user of the fact when the residual quantity of ink decreases, and a mechanism for preventing erroneous loading between inks.

Although a roll paper magazine (continuous paper) is shown in FIG. 5 as an example of the sheet feed unit 118, plural magazines with different paper width, different paper quality, or the like may be juxtaposed. Additionally, instead of the roll paper magazine or together with the roll paper magazine, sheets may be supplied by a cassette in which cut sheets are stacked in layers and loaded.

As the recording sheet 116 delivered from the sheet feed unit 118 is loaded into a magazine, its tendency to curl remains, and the recording sheet is curled. In order to remove this curling, in the decurling unit 120, heat is applied to the recording sheet 116 by a heating drum 130 in a direction opposite to the direction of the curling tendency of the magazine. At this time, it is more preferable that heating temperature is controlled so that the printing surface is somewhat weakly curled outward.

In the case of the configuration of an apparatus that uses a roll paper, like FIG. 5, a cutter 128 for cutting is provided, and the roll paper is cut into a desired size by the cutter 128. In addition, the cutter 128 is unnecessary when cut sheets are used.

The cut recording sheet 116 is fed to the belt conveying unit 122 after decurling. The belt conveying unit 122 is configured so as to have a structure where an endless belt 133 is wound between rollers 131 and 132.

The belt 133 has a width greater than the width of the recording sheet 116, and the surface of the belt is formed with a number of suction holes (not shown). As shown in this drawing, an adsorption chamber 134 is provided in a position that faces a sensor surface of the printing detection unit 124 and the nozzle surface of the printing unit 112 inside the belt 133 stretched between the rollers 131 and 132. The recording sheet 116 is adsorbed and held on the belt 133 by suctioning the adsorption chamber 134 into negative pressure which is achieved by a fan 135. In addition, an electrostatic adsorption method may be adopted instead of this suction adsorption method.

By transmitting the power of a motor that is not shown to at least one of the rollers 131 or 132 around which the belt 133 is wound, the belt 133 is driven in a clockwise direction in FIG. 5, and the recording sheet 116 held on the belt 133 is conveyed from the left to the right in FIG. 5.

Since ink even adheres on the belt 133 when an edgeless print or the like is printed, a belt cleaning unit 136 is provided in a given position (a suitable position other than a printing area) outside the belt 133. Although the configuration of the belt cleaning unit 136 is not shown in detail, for example, a method of nipping a brush roll, a water-absorbing roll, or the like, an air blow method of blowing pure air, or combinations thereof exist. In the case of a method of nipping a cleaning roll, the cleaning effect is profound when the belt linear speed and roller linear speed are changed.

In addition, although the aspect of using a roller nip conveyor mechanism is also considered instead of the belt conveying unit 122, since a roller contacts the printing surface of a sheet immediately after printing when the printing area is conveyed by a roller nip method, there is a problem in that an image is likely to bleed. Accordingly, the adsorption belt conveyance that enables prevention of an image surface from contact with a roller or the like in the printing area as in this example is preferable.

A heating fan 140 is provided upstream of the printing unit 112 on a sheet conveyance path formed by the belt conveying unit 122. The heating fan 140 blows heating air toward the recording sheet 116 before printing to heat the recording sheet 116. The ink is dried easily after ink droplets have spotted on a target by heating the recording sheet 116 just before printing.

Figure 6:
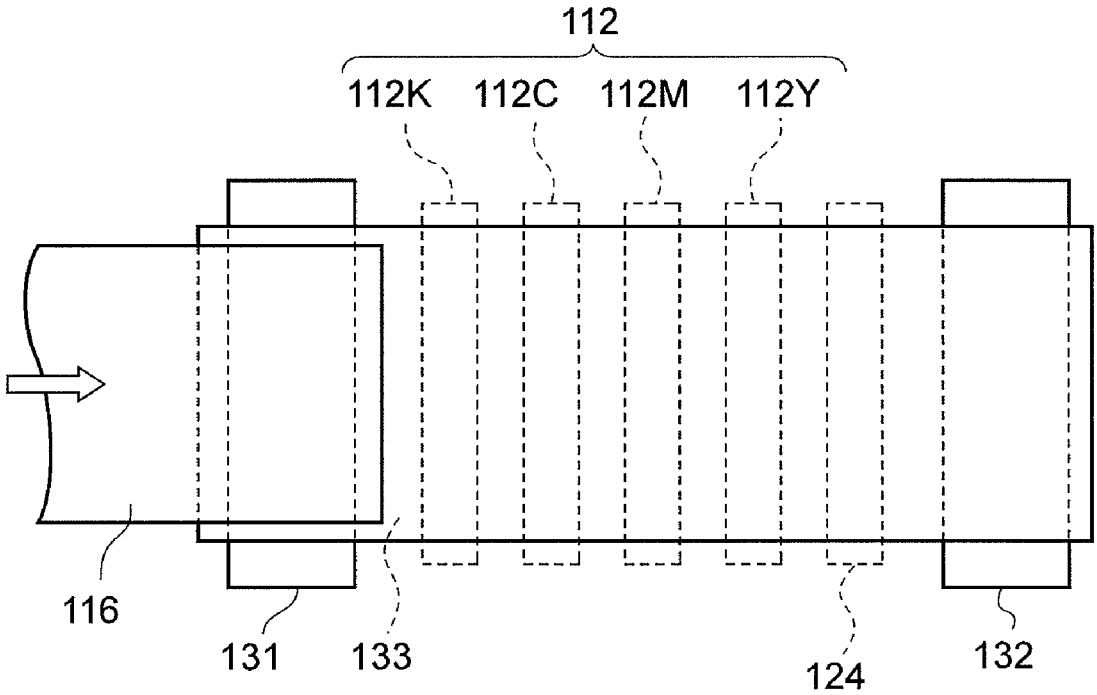
FIG. 6 is a schematic view showing an array state of a head in the image forming apparatus shown in FIG. 5.

Each of the heads 112K, 112C, 112M, and 112Y of the printing unit 112 is a full line type head that has a length corresponding to the maximum sheet width of the target recording sheet 116 targeted by the ink jet recording apparatus 110, and in which plural ink jetting nozzles are arrayed in the nozzle surface over a length (the full width of the range where drawing is available) exceeding at least one side of the maximum size of recording sheet 116 (refer to FIG. 6).

The heads 112K, 112C, 112M, and 112Y are arranged in color order of black (K), cyan (C), a magenta (M), and yellow (Y) from upstream in the feed direction of the recording sheet 116, and the heads 112K, 112C, 112M, and 112Y are fixed and installed so as to extend along a direction approximately perpendicular to the conveying direction of the recording sheet 116.

A color image can be formed on the recording sheet 116 by jetting different color inks from the heads 112K, 112C, 112M, and 112Y, respectively, while the recording sheet 116 is conveyed by the belt conveying unit 122.

In this way, according to the configuration in which the full line type heads 112K, 112C, 112M, and 112Y that have a nozzle row that covers the whole region of sheet width are provided according to color, an image can be recorded on the whole surface of the recording sheet 116 by performing once the operation of moving the recording sheet 116 and the printing unit 112 relative to each other in the sheet feed direction (that is, by one sub-scanning direction). This allows high-speed printing compared with a shuttle type head in which a recoding head reciprocates in a direction perpendicular to the sheet conveying direction, thereby productivity can be improved.

Although the configuration of standard colors (four colors) of KCMY has been illustrated in this example, combinations of ink colors or the number of colors are not limited to this embodiment. If necessary, light ink, dark ink, and special color ink may be added. For example, a configuration in which ink-jet heads that jet light inks, such as a light cyan and a light magenta, are added is also possible. Additionally, the arrangement order of the respective color heads is also not particularly limited.

The printing detection unit 124 shown in FIG. 5 includes an image sensor (a line sensor or an area sensor) for imaging the droplet spotting results of the printing unit 112, and functions as a means to check jetting characteristics, such as nozzle clogging, and spotting position errors, from a droplet spotting image read by this image sensor.

A CCD area sensor in which plural light-receiving elements (photoelectric conversion elements) are two-dimensionally arrayed on a light-receiving surface can be preferably used for the printing detection unit 124 of this example. The area sensor has an imaging range where the whole region of at least an ink jetting width (image recording width) by each of the heads 112K, 112C, 112M, and 112Y can be imaged. The required imaging range may be realized by one area sensor, and the required imaging range may be secured by combining (connecting) plural area sensors. Alternatively, a configuration is also available in which an area sensor is constituted by a moving mechanism (not shown), and the required imaging range is imaged by moving (scanning) the area sensor.

Additionally, a line sensor can also be used instead of the area sensor. In this case, the line sensor preferably has a configuration including a row of light-receiving elements (a row of photoelectric conversion elements) that are wider than at least the ink jetting width (image recording width) by each of the heads 112K, 112C, 112M, and 112Y.

In this way, the printing detection unit 124 that is a block including an image sensor reads an image printed on the recording sheet 116, performs required signal processing or the like to detect the printing status (status of jetting, a spotting position error, a dot shape, optical density, etc.), and provides a print control unit and a system controller (not shown) with the detection results.

A rear drying unit 142 is provided at a subsequent stage of the printing detection unit 124. The rear drying unit 142 is a means to dry a printed image surface, for example, a heating fan is used. Since it is preferable to inhibit contacting a printing surface until the ink after printing is dried, a method that blows heated air is preferable.

When a porous paper has been printed with dye-based ink, there is an effect that the weather resistance of an image is enhanced by blocking holes of the paper by pressing, thereby preventing contact with those substances that cause dye molecules to break, such as ozone.

A heating/pressing unit 144 is provided at a subsequent stage of the rear drying unit 142. The heating/pressing unit 144 is a unit for controlling the glossiness of the surface of an image, which presses the image surface by a pressing roller 145 having a predetermined uneven surface shape while heating the image surface, and transfers the uneven shape to the image surface.

A printed article generated in this way is ejected from the sheet ejection unit 126. It is preferable that an original image (image obtained by printing a target image) to be originally printed be separated from a test print and then ejected. In the ink-jet recording apparatus 110, in order to sort out the printed article of an original image, and the printed article of a test print in order to feed them to sheet ejection units 126A and 126B, respectively, a sorting unit (not shown) that switches the sheet ejection path is provided.

In addition, when an original image and a test print are simultaneously formed in parallel on a larger sheet, the test print portion is separated by the cutter 148. Additionally, although not shown in the drawing, a sorter that accumulates images in order is provided in the sheet ejection unit 126A for the original images.

Since the droplet jetting head of the invention obtained by the manufacturing method of the invention has excellent durability and jetting stability, it can be widely applied to, for example, formation of a color filter, drawing of wiring lines, or the like in addition to the above image recording apparatus, and the application range thereof is wide.

EXAMPLES

Example 1

A silicon substrate with a thickness of 625 μm is prepared (FIG. 2A). A patterned mask 30 was formed by using OFPR-800 (made by Tokyo Ohka Kogyo Co., Ltd.) as a resist material to form a coating film on the silicon substrate with a resist film thickness of 1 μm, performing pattern exposure with the amount of exposure of 120 mJ/cm$^2$ by an aligner (made by Union company), then dipping the substrate for about 60 seconds in a developer tank filled with NMD-3 (made by Tokyo Ohka Kogyo Co., Ltd.) as a developer, then performing rinsing with pure water twice for 60 seconds, then performing cleaning with running water for 300 seconds, and then removing moisture on the substrate by a spin dryer, or the like (FIG. 2B).

After the development, the substrate was heated and post baked for 1.5 minutes at 110° C. by a hot plate.

Thereafter, a recess was formed by dry etching (refer to FIG. 2C). The dry etching process was performed for 15 seconds in a state where the flow rate of $SF_6$ is 200 sccm, the degree of vacuum is 3 Pa, the RF output for plasma production is 2000 W, and bias output is 15 W, and subsequently, the protective film forming process was performed for 10 seconds in a state where the flow rate of $C_4F_8$ is 100 sccm, the degree of vacuum is 1 Pa, the RF output for plasma production is 1500 W, and bias output is 0 W. The etching process and the protective film fanning process were repeatedly performed for 20 minutes.

A recess with a depth of about 100 μm for the formation of the pressure supply unit 26 was formed using PEGASUS made by Sumitomo Precision Products Co., Ltd. as an apparatus for the Bosch process.

Thereafter, the resist mask was removed (FIG. 2D).

The removal of the resist mask was performed under the ashing treatment condition of oxygen gas of 200 sccm, 30 Pa, and a microwave output of 1 kW by SWP or the like using microwaves, using STRIPPER-502A by Tokyo Ohka Kogyo Co., Ltd.

Thereafter, the mask pattern 32 for formation of a through hole was formed (FIG. 2E). The mask pattern 32 was formed by spinning the substrate for 60 seconds at 1000 rpm by the spin coat method, using AZ10XT (220 cP) made by AZ Company as a resist material, thereby forming a resist film with a film thickness of about 10 μm, and subsequently performing the prebake of heating the resist film for 180 seconds at 110° C. by a hot plate.

Pattern exposure was performed on the formed resist film with an exposure amount of 825 mJ/cm$^2$ by using a contact aligner. As for the development, the substrate was dipped in an developing solution of AZ300MIF developer for 600 seconds, and then rinsed with pure water twice for 60 seconds, and then dipped in running water for 180 seconds, and then spin-dried or nitrogen-blown to remove moisture, whereby the patterned mask 32 for formation of a through hole was obtained.

The formed patterned mask was heated and cured for 120 seconds at 130° C. by a hot plate. The resist pattern was made into a round shape from a rectangular shape by this heating (FIG. 2F). The through hole at this time was a circular shape with a diameter of 200 μm, and a curvature radius of the formed round shape was 10 μm.

After the through hole was formed in the substrate on which the patterned mask was formed, the dry etching was performed under the condition that the selection ratio of the etching rate of the resist mask and the silicon substrate became 1 or less. The dry etching was performed under the condition that the flow rate of $SF_6$ was 75 sccm, the flow rate of $O_2$ was 25 sccm, the degree of vacuum was 1 Pa, the RF output for plasma production was 1000 W, and the bias output was 100 W. By etching silicon in a state of the selection ratio with the resist being one or less in this way, the round shape of the mask shape was transferred to the silicon substrate, and formation of the round shape of the end of the through hole was performed by dry etching (FIGS. 2G to 2H).

Thereafter, the mask was removed (FIG. 2I). The removal of the resist mask was performed by the ashing treatment using oxygen plasma. The ashing treatment was performed under the ashing treatment condition of oxygen gas of 200 sccm, 30 Pa, and a microwave output of 1 kW by SWP or the like using microwaves.

Finally, fluorine-based polymers formed at the time of silicon dry etching were removed using Novec by Sumitomo 3M Company, and hydrophilization treatment of the silicon substrate was performed by plasma treatment using oxygen plasma.

Next, both substrates were bonded together with the adhesive 24 so that the through hole 20 of the obtained substrate 22 that fauns a flow passage and the opening 16 that supplies a liquid to the pressure chamber 12 in the substrate 18 that forms a pressure chamber substantially align with each other.

In this step, first, an epoxy adhesive (EW2050 made by Sumitomo 3M) was applied to the substrate 22 that forms a flow passage to form the adhesive layer 24 with a thickness of 10 μm (FIG. 4J).

Thereafter, the substrates were stuck together (FIG. 4K). At this time, when the substrate 22 that forms a flow passage was brought into pressure contact with the substrate 18 that forms a pressure chamber, a part of the used adhesive 24 was extruded from between the substrates, and stretched along the surface toward the inside of the through hole 20 provided in the substrate 22 that forms a flow passage.

Thereafter, the substrate 18 that forms a pressure chamber and the substrate 22 that forms a flow passage were integrated together by heating at 120° C. to cure the adhesive 24, whereby the droplet jetting head 10 of the invention was formed.

Figure 7:
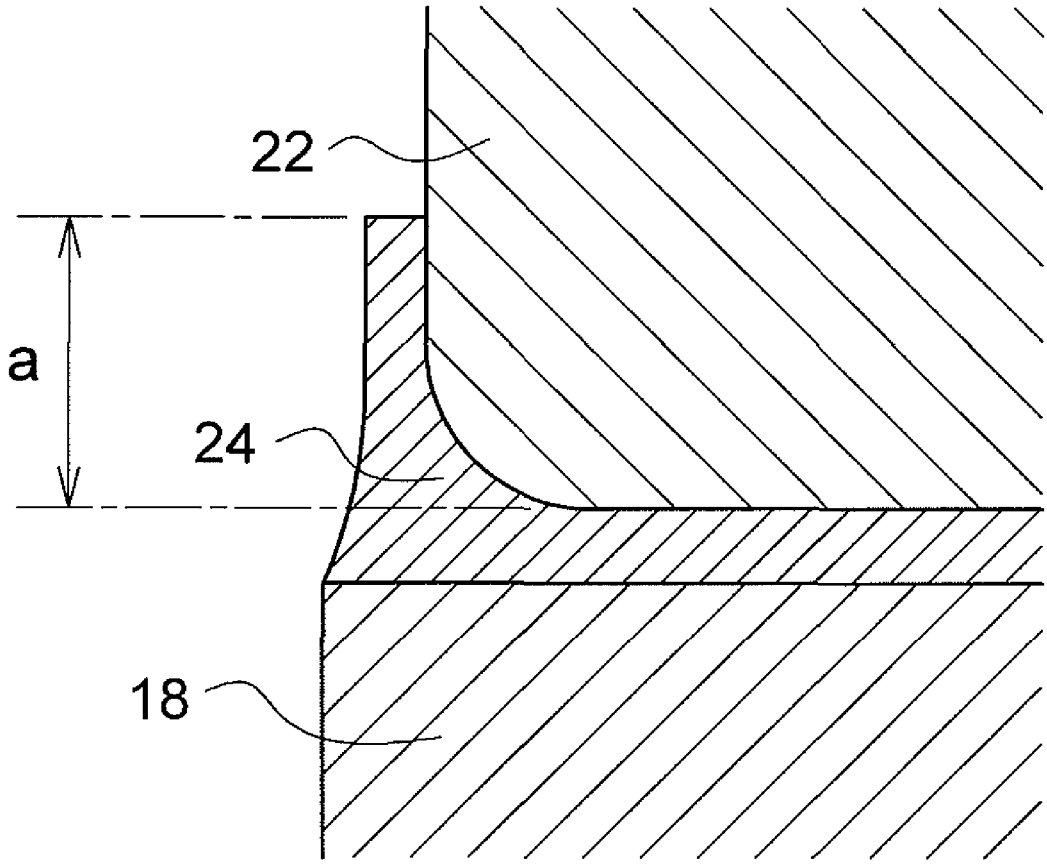
FIG. 7 is a schematic view showing the state of a junction between the first substrate that forms a flow passage and the second substrate that forms a pressure chamber in Example.

FIG. 7 is a partially enlarged schematic view showing the state of a junction between the substrate 18 and the substrate 22 in the droplet jetting head. As shown in FIG. 7, the cured adhesive layer 24 extended 10 μm (the length a as shown in FIG. 7) inside the through hole 20 of the substrate 22. Additionally, it was found that, although the thickness of the adhesive layer 24 varied depending on the viscosity of an adhesive or the pressing conditions at the time of joining, the thickness thereof was 7 to 8 μm at the maximum, and a protruding portion capable of affecting the fluidity of a liquid in the flow passage formed by through hole 20 was not formed.

(Evaluation of Droplet Jetting Head)

The obtained droplet jetting head was assembled into an ink-jet recording apparatus as an ink-jet print head, and while a cyan ink was supplied, the ink was jetted intermittently for 100 hours (such that 2000 sheets of A4 paper were printed). During this time, jetting failure, such as nozzle clogging, did not occur.

Thereafter, when the droplet jetting head was taken out and a junction between the substrate that forms a pressure chamber and the substrate that forms a flow passage was visually observed, no abnormality was observed at the junction. Additionally, damage, such as melting or peeling of the adhesive layer caused by the ink, was not seen on the surface of the adhesive layer.

It can be seen from these results that the droplet jetting head of the invention obtained by the manufacturing method of the invention has excellent durability, and suppresses the occurrence of problems that occur over time due to extrusion of adhesive.

All publications, patent applications, and technical standards mentioned in this specification are herein incorporated by reference to the same extent as if each individual publication, patent applications, or technical standards was specifically and individually indicated to be incorporated by reference.

What is claimed is:

1. A method of manufacturing a droplet jetting head that jets droplets to a recording medium on the basis of image information, thereby forming dots on the recording medium to form an image indicated by the image information on the recording medium, the method comprising:

forming a patterned mask to create a flow passage in a silicon substrate used in the fabrication of a first substrate that forms a flow passage;

curing the patterned mask, in which the patterned mask is heated to form a round shape at the end of the patterned mask; forming a through hole by dry etching, and then providing a round shape to an end of the through hole by dry etching, thereby providing the first substrate with a through hole having a round shape having a curvature radius of 1 to 100 μm formed at an end thereof; and bonding the first substrate with a second substrate having a pressure chamber with an adhesive, so that the through hole of the obtained first substrate, and an opening that supplies liquid to the pressure chamber in the second substrate substantially align with each other.

2. The method of manufacturing a droplet jetting head according to claim 1, wherein the heating temperature in heating of the mask is within a range of from T° C. to T+100° C., where the melting point of a material that forms a mask is T° C.

3. The method of manufacturing a droplet jetting head according to claim 1, wherein the thickness of the mask is from 3 to 15 μm.

4. The method of manufacturing a droplet jetting head according to claim 1, wherein dry etching is performed under the condition that the dry etching selection ratio between a material that forms a mask and a first substrate material is 1 or less after the forming of the through hole.

5. The method of manufacturing a droplet jetting head according to claim 1, further comprising performing a surface treatment, which improves the wetting property of the adhesive, on the surface of the first substrate having the through hole having a round shape at the end thereof, prior to the bonding, but after the forming of the through hole.

6. The method of manufacturing a droplet jetting head according to claim 1, wherein the bonding includes forming an adhesive layer on the surface of the first substrate, bringing the second substrate into pressure contact with the surface of the adhesive layer, and curing the adhesive.

7. The method of manufacturing a droplet jetting head according to claim 1, wherein the adhesive extends along the inside of the through hole of the first substrate after the bringing the second substrate into pressure contact with the surface of the adhesive layer.

8. A droplet jetting apparatus comprising the droplet jetting head obtained by the method of manufacturing a droplet jetting head according to claim 1.

9. The method of manufacturing a droplet jetting head according to claim 1, wherein the adhesive extends along the inside of the through hole of the first substrate.

10. The method of manufacturing a droplet jetting head according to claim 1, wherein the first substrate and the second substrate are each a silicon substrate.

11. The method of manufacturing a droplet jetting head according to claim 1, wherein a through hole inner surface of the second substrate is formed with a silicon oxide film, or is subjected to water-repellent treatment.

12. The method of manufacturing a droplet jetting head according to claim 10, wherein the silicon substrate of the second substrate has a fluorine-based polymer as a protective film.

13. The method of manufacturing a droplet jetting head according to claim 1, wherein the adhesive viscosity is an epoxy-based adhesive having about 100 to 100000 cP.

* * * * *